United States Patent [19]

Edwards

[11] Patent Number: 5,001,914

[45] Date of Patent: Mar. 26, 1991

[54] PICK-RESISTANT LOCK

[75] Inventor: Charles C. Edwards, Greeneville, Tenn.

[73] Assignee: Hurd Lock and Manufacturing Co., Inc., Greeneville, Tenn.

[21] Appl. No.: 558,306

[22] Filed: Jul. 24, 1990

[51] Int. Cl.[5] ..... E05B 29/04

[52] U.S. Cl. ..... 70/495; 70/419

[58] Field of Search ..... 70/492, 495, 496, 419

[56] References Cited

U.S. PATENT DOCUMENTS

| | | | |
|---|---|---|---|
| 225,808 | 3/1880 | Deitz | 70/496 |
| 1,906,701 | 5/1933 | Maxwell et al. | 70/421 |
| 1,915,897 | 6/1933 | Maxwell et al. | 70/407 |
| 2,004,433 | 6/1935 | Fitz Gerald | 70/419 |
| 2,019,655 | 11/1935 | Centofanti | 70/492 |
| 2,629,247 | 7/1948 | Deutsch | 70/340 |
| 2,660,876 | 12/1953 | Spain | 70/495 |
| 2,879,658 | 3/1959 | Johnstone | 70/495 |
| 3,035,433 | 5/1962 | Testa | 70/495 |
| 3,479,848 | 11/1969 | Golden | 70/495 |
| 4,561,270 | 12/1985 | Spreng | 70/495 |
| 4,750,342 | 6/1988 | Nakai | 70/496 |

FOREIGN PATENT DOCUMENTS

| | | | |
|---|---|---|---|
| 508250 | 12/1954 | Canada | 70/495 |
| 853429 | 10/1970 | Canada | 70/495 |
| WO87/04749 | 8/1987 | PCT Int'l Appl. | 70/495 |

*Primary Examiner*—Lloyd A. Gall

*Attorney, Agent, or Firm*—Luedeka, Hodges, Neely & Graham

[57] ABSTRACT

A pick-resistant lock having a housing and a keyway cylinder rotatably mounted within the housing includes a plurality of tumblers and a lock bar associated with the cylinder to render picking of the lock difficult by conventional techniques. The housing has a cylinder-accepting bore provided with a pair of locking grooves arranged so as to face one another. The tumblers and lock bar are movable into and out of locking relationship with a corresponding one of the locking grooves and along parallel paths when the cylinder is positioned in a lock mode position. Springs mounted within the cylinder urge the lock bar and tumblers against one another and toward positions out of the locking grooves while maintaining the lock bar in a locked relationship within its corresponding locking groove so that the cylinder is prevented from rotating. Insertion of the proper key within the cylinder shifts the tumblers and lock bar to positions at which the cylinder may be rotated, but improper manipulations of the cylinder and tumblers may either bind the lock bar in a locked relationship within its corresponding locking groove or shift a tumbler into a locked relationship within its corresponding locking groove.

6 Claims, 4 Drawing Sheets

PICK-RESISTANT LOCK

BACKGROUND OF THE INVENTION

This invention relates generally to locks and relates more particularly to locks which are used in common industrial applications, such as those used to lock desk drawers, tool boxes, vending machine cabinets or similar applications normally requiring the rotation of a locking member between two angular positions.

The class of lock to which this invention pertains includes a housing having an internal bore, a keyway cylinder supported within the bore of the housing for rotation relative to the housing, and a plurality of tumblers mounted within the cylinder for movement into and out of tumbler-accepting locking grooves provided along an inside wall of the housing. The tumblers are spring-biased toward the inside wall of the housing so that when the tumblers are received in the locking grooves, the cylinder is prevented from rotating. By fully inserting the appropriate key within the cylinder, the tumblers are moved out of the locking grooves so that the cylinder may be rotated.

A lock of the aforedescribed class can commonly be picked by inserting a picking instrument into the keyway of the cylinder to force the tumblers to an unlocked condition and simultaneously exerting a torsion force upon the cylinder. The torsion force applied to the cylinder is normally sufficient to cause each tumbler which has been manipulated out of the locking groove to an unlocked position, to frictionally catch on the inside wall of the housing so that the caught tumbler is maintained in an unlocked condition while the other tumblers are manipulated out of the locking groove. Once all of the tumblers have been caught on the inside wall of the housing, the cylinder can be turned.

It is an object of the present invention to provide a new and improved lock which possesses improved pick-resistant qualities.

Another object of the present invention is to provide such a lock which is uncomplicated in construction and effective in operation.

SUMMARY OF THE INVENTION

This invention comprises a lock having a housing, a key-accepting cylinder, a plurality of tumblers, and a lock bar. The housing includes a bore and a pair of locking grooves defined in and arranged along the surface of the bore so that the locking grooves generally open toward one another across the bore. The key-accepting cylinder is mounted within the bore of the housing for accepting a key inserted within the cylinder and for rotation relative to the housing about a rotational axis between one angular position and another angular position.

The tumblers are mounted within the cylinder for movement relative thereto along linear parallel paths oriented substantially transverse to the rotational axis of the cylinder and between a first, or fully, retracted position and an extended position. Each tumbler includes a tab portion which is positioned within one locking groove of the housing to prevent the cylinder from rotating within the housing when the tumbler is positioned in its extended position and which is withdrawn from the one locking groove when the tumbler is positioned in its first retracted position.

The lock includes a lock bar mounted within the cylinder for movement relative thereto along a linear path which is oriented generally parallel to the paths along which the tumblers are permitted to move relative to the cylinder and between an extended position and a retracted position. The lock bar includes a protruding portion which is positioned within the other locking groove of the housing to prevent the cylinder from rotating when the lock bar is positioned in its extended position and which is withdrawn from the other locking groove when the lock bar is positioned in its retracted position.

The lock further includes tumbler biasing means for biasing each tumbler from its extended position toward its first retracted position and lock bar biasing means for biasing the lock bar from its extended position toward its retracted position. Thus, the lock bar and tumblers are biased by the corresponding biasing means in opposite directions. Importantly, the lock bar and tumblers are arranged in abutting relationship so that the tumblers and the lock bar are urged against one another by the aforesaid biasing means. Thus, the lock bar biasing means acts against the tumblers through the lock bar, and the tumbler biasing means act against the lock bar through the tumblers.

The locking grooves are arranged within the surface of the housing bore in such a relation to the cylinder that when the cylinder is positioned within the housing in the one angular position, the one locking groove is aligned with and positioned to accept the tab portion of the tumbler when the tumbler is moved to its extended position, and the other locking groove is aligned with and positioned to accept the protruding portion of the lock bar when the lock bar is moved to its extended position. The tumbler biasing means and the lock bar biasing means possess predetermined strengths so that when the cylinder is positioned in the one angular position and no key is positioned within the cylinder, the lock bar is positioned in its extended position and each tumbler is positioned in its first retracted position.

The tumblers are cooperable with a key insertable within the key-accepting cylinder so that insertion of the key within the cylinder moves each tumbler in opposition to the tumbler biasing means from its first retracted position to a second retracted position located intermediate of the first retracted position and the extended position of the tumbler to permit the lock bar biasing means to move the lock bar from its extended position to its retracted position so that the cylinder may be rotated relative to the housing from the one angular position to another angular position.

By insertion of the proper key within the cylinder, the cylinder may be rotated within the housing. However, if torsion is applied to the cylinder before the proper key has been inserted therein, the protruding portion of the lock bar binds within the other locking groove to prevent the cylinder from rotating. Moreover, if any of the tumblers are moved by, for example, a picking instrument to the extended position at which a tumbler tab portion is received by the one locking groove, the received tab portion prevents the cylinder from rotating.

DETAILED DESCRIPTION OF AN ILLUSTRATIVE EMBODIMENT

Figure 1:
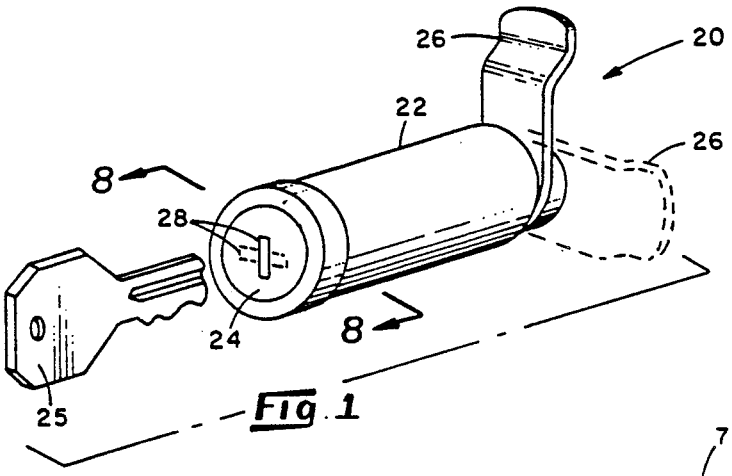
FIG. 1 is a perspective view of an embodiment of a lock shown with a key removed from the key-accepting cylinder of the lock.
Figure 2:
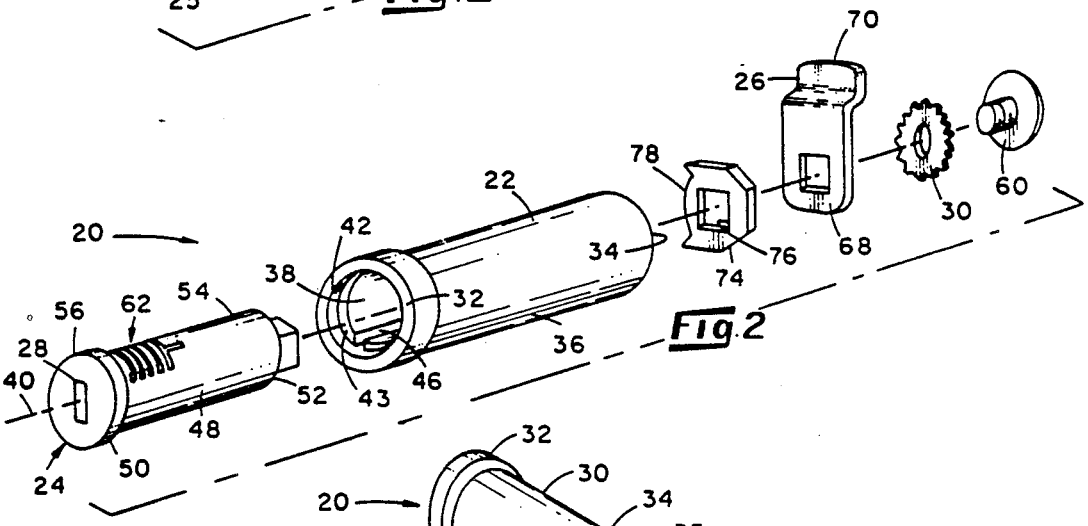
FIG. 2 is an exploded perspective view of the FIG. 1 lock.
Figure 8:
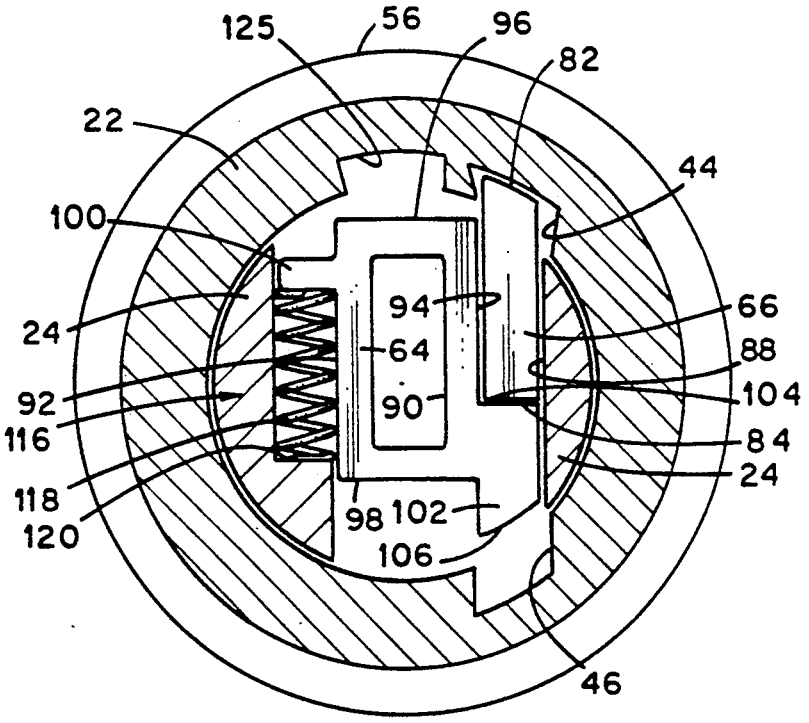
FIG. 8 is a cross-sectional view taken along lines 8—8 of FIG. 1 illustrating the position of the lock bar and tumblers of the FIG. 1 lock when the cylinder of the lock is positioned in its lock mode position.

Turning now to the drawings in greater detail, there is illustrated in FIGS. 1 and 2 an embodiment of a lock 20 of a type which may be used in any of several commercial applications requiring that a locking member associated with the lock 20 be rotated through about ninety degrees of angular displacement to lock or unlock an object. Such objects include, for example, desk drawers, tool boxes and vending machine cabinets. The lock 20 includes a housing 22, a key-accepting cylinder 24 rotatably mounted within the housing 22 for accepting a key 25 and a lock member 26 affixed to one end of the cylinder 24 for movement therewith as the cylinder 24 is rotated relative to the housing 22 between locked and unlocked positions. For purposes of this disclosure, the vertical attitude of the key is chosen to correspond to the "locked" position of the cylinder (as shown in FIG. 8). Accordingly, when the cylinder 24 is positioned in its locked condition so that its key-receiving slot, indicated 28, is oriented substantially vertically, the locking member 26 is oriented substantially vertically as shown in solid lines in FIG. 1. By comparison, when the cylinder 24 is positioned in its unlocked condition so that the key-receiving slot 28 is oriented substantially horizontally, the locking member 26 is oriented substantially horizontally as indicated in phantom in FIG. 1.

Figure 3:
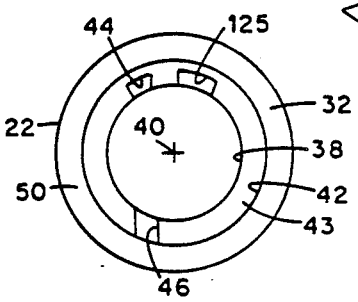
FIG. 3 is a front elevational view of the housing of the FIG. 1 lock.

With reference to FIGS. 2 and 3, the housing 22 includes a body 30 which is elongate in form with opposite front and rear ends 32, 34, respectively, and which has a substantially cylindrical outer surface 36 extending between the ends 32, 34. The housing 22 is provided with a central bore 38 extending along the longitudinal axis, indicated 40, of the housing 22, and a circular recess 42 having a larger diameter than that of the bore 38 is provided adjacent the front end 32 of the housing 22 so as to provide a forwardly-facing shoulder 43. There is provided along the surface of the bore 38 two opposing locking grooves 44, 46 which open generally toward one another and extend rearwardly through the housing 22 from the front end 32 thereof for a substantial portion of the housing length. There is also provided along the surface of the bore 38 a locking groove 125 which extends rearwardly through the housing 22 from the front end 32 for a substantial portion of the housing length. The housing body 30 also includes a rearwardly-directed lug 35, best shown in FIG. 4, adjacent end 34 for reasons apparent herein.

The locking groove 44 is somewhat U-shaped in cross-section with opposing sidewalls which in a preferred embodiment converge toward one another adjacent the surface of the bore 38. The locking groove 46 is also somewhat U-shaped in cross-section with opposing sidewalls which in the depicted embodiment are generally parallel to one another. In addition, each opposing sidewall of a groove 44 or 46 meets the surface of the bore 38 at a relatively sharp corner.

Figure 4:
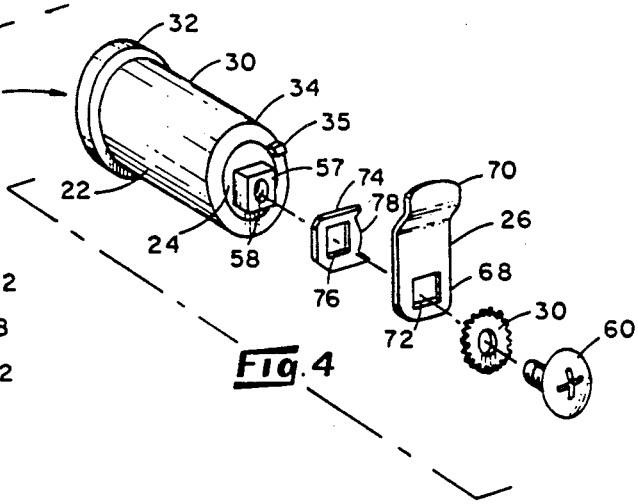
FIG. 4 is a perspective view of the FIG. 1 lock shown exploded and illustrated at an alternative angle to that of the view of FIG. 2.

With reference again to FIG. 2, the key-accepting cylinder 24 of the lock 20 includes a body 48 which is elongate in form with opposite forward and rearward ends 50, 52, respectively. A cylindrical outer surface 54 extends for a substantial distance along the length of the cylinder 24, and a section 56 of enlarged diameter is provided adjacent the forward end 50. When the cylinder 24 is operatively positioned within the housing 22 so that the cylinder body 48 extends along the bore 38, the cylinder section 56 is positioned within the recess 42 provided adjacent the front end 32 of the housing 22 so as to abuttingly engage the forwardly-facing shoulder 43. As best shown in FIG. 4, a boss 57 of substantially square cross-section is provided at the rearward end 52 of the cylinder 24, and an internally-threaded opening 58 is defined in the boss 57 for threadably accepting a screw 60. The body 48 of the key-accepting cylinder 24 also includes a network 62 of recesses and slots for receiving a plurality of tumblers 64 (FIG. 7) and a lock bar 66 in a manner described herein, and the key-receiving slot 28, mentioned earlier, extends axially through the cylinder body 48 from the forward end 50 thereof.

In order to limit the rotational movement of the cylinder 24 relative to the housing 22, a stop member 74 having a square opening 76 therethrough and a notch 78 defined along its outer periphery, is positioned upon the boss 57 for movement therewith as the cylinder 24 is rotated. The notch 78 of the stop member 74 is appropriately sized for accepting the housing lug 35. When the stop member 74 is positioned upon the boss 57, rotation of the cylinder 24 in one rotational direction or the other moves the sides of the notch 78 into abutting relationship with the housing lug 35 to thereby limit the cylinder rotation to about ninety degrees of angular displacement. In the depicted lock 20, the stop member 74 is positioned upon the boss 57 to permit movement of the cylinder 24 in a clockwise direction, as the lock 20 is viewed frontally, when the cylinder 24 is moved from its locked to its unlocked position and to permit cylinder movement in a counter-clockwise direction when the cylinder 24 is moved from its unlocked to its locked position.

The locking member 26 is platen-like in form and includes two opposite ends 68, 70 and a square opening 72 adjacent end 68. When securing the locking member 26 to the remainder of the lock 20, the locking member 26 is placed over the rearward end 52 of the cylinder 24 so that the boss 57 is received in the square opening 72. The screw 60 is then tightened within the internally-threaded aperture 58 to securely hold the locking member 26 upon the end. If desired, a star washer 30 may be interposed between the locking member 26 and the head of the screw 60. It follows that with the locking member 26 secured about the boss 57 as aforedescribed, the locking member 26 must rotate with the cylinder 24 as the cylinder 24 is rotated within the housing 24.

Figure 5:
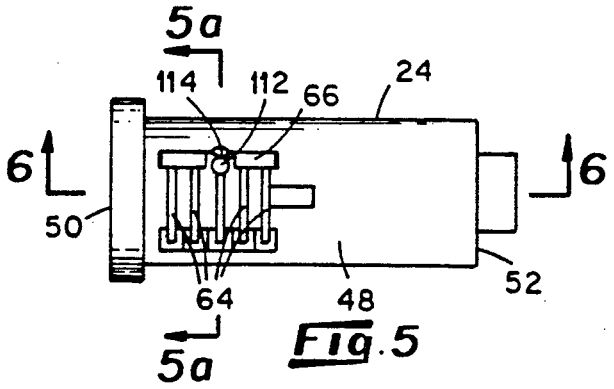
FIG. 5 is a plan view of the cylinder of the FIG. 1 lock as seen from above in FIG. 2.
Figure 6:
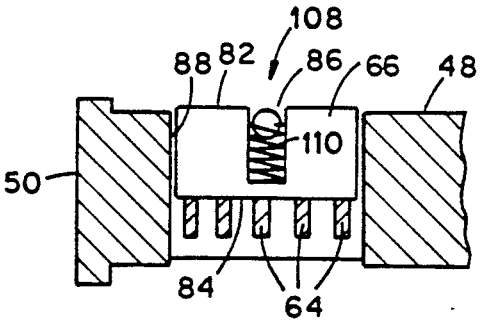
FIG. 6 is a cross-sectional view taken along line 6—6 of FIG. 5.
Figure 7:
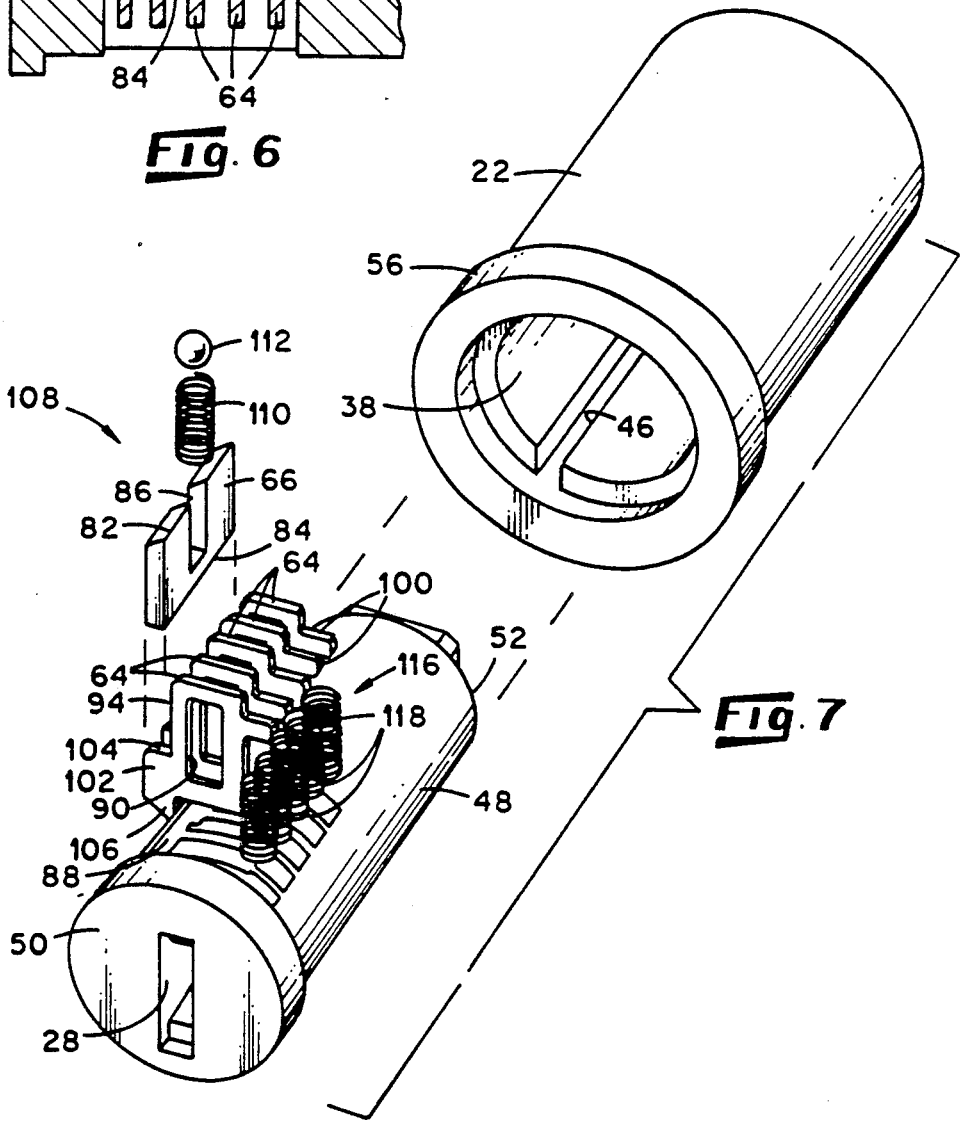
FIG. 7 is a view similar to that of FIG. 2 illustrating the cylinder of the FIG. 1 lock in an exploded condition.

With reference to FIGS. 5–7, the lock bar 66 of the lock 20 is platen-like in form with two opposite ends and with opposite upper and lower edges 82, 84, respectively, as viewed in FIG. 6. The lock bar 66 also includes a notch 86 in the upper edge 82 which is located substantially midway between the opposite ends of the lock bar 66 so as to open outwardly and generally upwardly (as viewed in FIGS. 5–7). The network 62 of recesses in the cylinder body 48 includes a through-slot 88 within which the lock bar 66 is positioned. As will be apparent herein, the lower edge 84 of the lock bar 66 rests upon a portion of the tumblers 64 which extend into the slot 88 as shown in FIG. 6.

Figure 9:
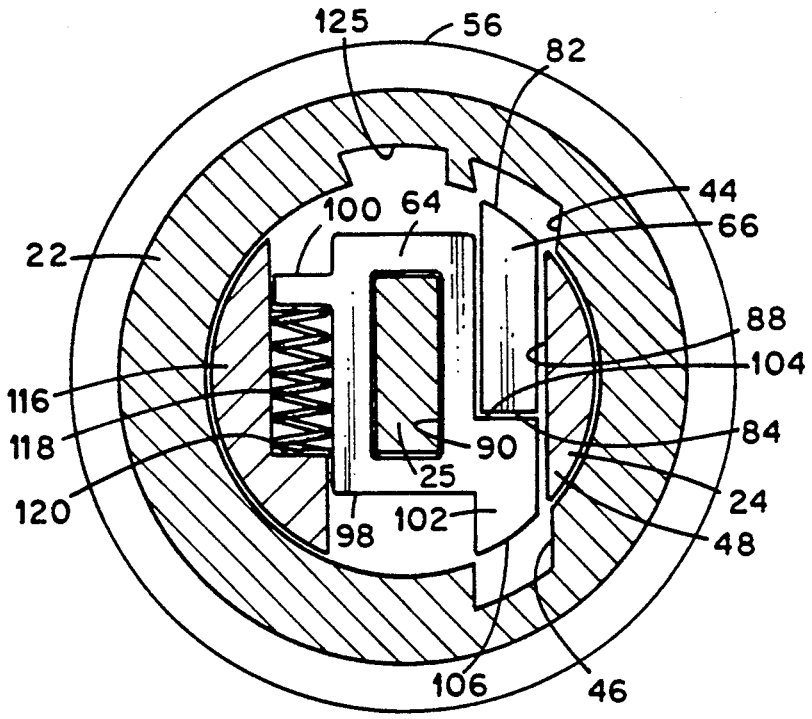
FIGS. 9 and 10 views similar to that of FIG. 8 illustrating alternative positions of the lock bar and tumblers of the FIG. 1 lock relative to the key-accepting cylinder of the lock while the cylinder remains in its lock mode position.
Figure 10:
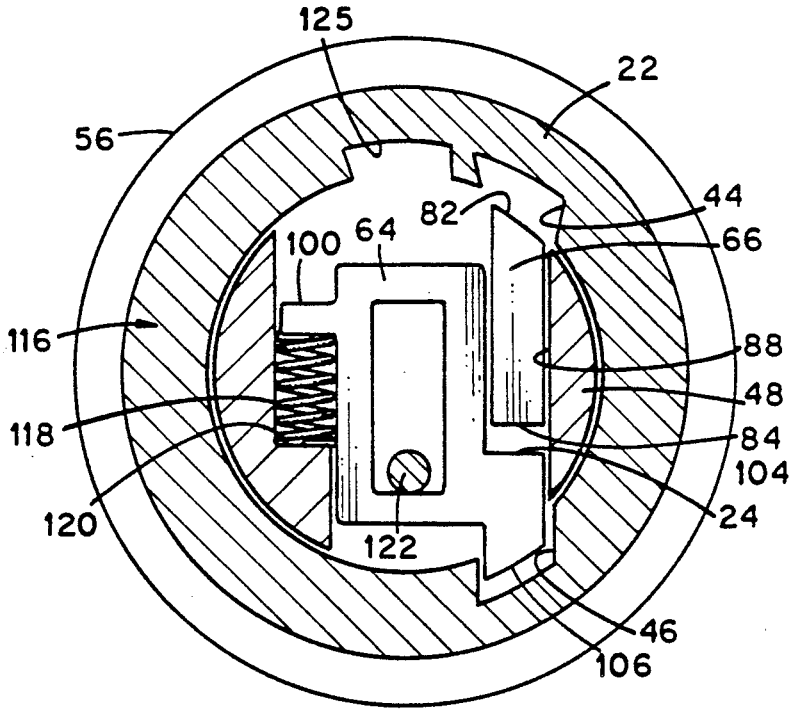

The lock bar 66 is mounted within the cylinder body slot 88 so that its opposite ends face directions which correspond with the forward and rearward ends 50, 52 of the cylinder body 48 and for movement relative to the cylinder body 48 between an extended position as illustrated in FIG. 8 at which the upper edge 82 of the lock bar 66 protrudes from the cylindrical surface of the cylinder 24 and a retracted position as illustrated in FIGS. 9 and 10 at which the lock bar 66 is completely retracted within the cylinder slot 88. When the cylinder 24 is in a rotational position within the housing 22 corresponding to a lock mode of the lock 20 and the key 25 is removed from the cylinder 24, the lock bar 66 is positioned in its extended position so that its upper edge 82 is received by the locking groove 44 as illustrated in FIG. 8. Accordingly, the locking groove 44 is appropriately sized to accept the lock bar upper edge 82. To unlock the cylinder 24 from the housing 22, the key 25 is inserted within the cylinder 24 to effect the movement of the lock bar 66 from its extended position to its retracted position in a manner described herein.

With reference to FIGS. 7 and 8, each tumbler 64 is platen-like in form and is mounted within an appropriately-sized transversely-extending slot defined within the cylinder body 48 so that the planar form of each tumbler 64 is oriented generally transverse to the longitudinal axis of the cylinder 24. Each tumbler defines a substantially rectangular opening 90 for receiving the key 25 when inserted through the cylinder keyway slot 28 and is shaped so as to include two opposite and parallel side edges 92, 94 and two opposite and parallel end edges 96, 98. Protruding from one side edge 92 of the tumbler 64 is a tab 100 whose purpose will be apparent herein, and protruding from the other side edge 94 and the end edge 98 of the tumbler 64 is a tab portion 102. The tab portion 102 is shaped so as to provide a shoulder surface 104 which generally faces the lower edge 84, as viewed in FIG. 8, of the lock bar 66 and so as to provide a free end 106 which extends from the tumbler end edge 98. The tumbler opening 90 is sized to accept a key 25 (FIG. 9) inserted into the key-receiving slot 28 of the cylinder 24.

Each tumbler 64 is mounted within the cylinder body 48 for movement relative to the cylinder body 48 between a fully retracted position as illustrated in FIG. 8 at which the tumbler tab portion 102 is spaced an appreciable distance from the locking groove 46 and an extended position as illustrated in FIG. 10 at which the tab portion end 106 protrudes outwardly from the cylindrical surface of the cylinder 24 and is accepted by the locking groove 46. As each tumbler 64 moves between its FIG. 8 fully retracted position and its FIG. 10 extended position, the tumbler 64 passes through an intermediate position as illustrated in FIG. 9 at which the tab portion end 106 is withdrawn from the locking groove 46. As will be apparent herein, the insertion of the key 25 into the key-receiving slot 28 of the cylinder 24 effects a movement of each tumbler 64 to the FIG. 9 intermediate position.

When the cylinder 24 is in a rotational position within the housing 22 corresponding to the lock mode of the lock 20, the tab portion end 106 and locking groove 46 are aligned with one another for acceptance of the tab portion end 106 by the locking groove 46. Accordingly, the locking groove 46 is appropriately sized to accept the tab portion end 106.

Figure 5A:
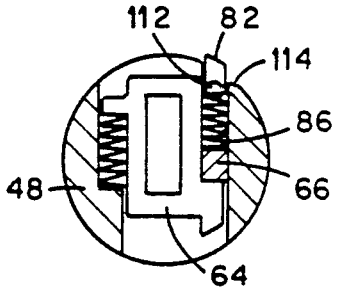
FIG. 5*a* is a cross-sectional view taken along line 5*a*—5*a* of FIG. 5.

The lock 20 also includes means, indicated 108 in FIGS. 6 and 7, for biasing the lock bar 66 from its FIG. 8 extended position to its FIG. 9 retracted position at which the upper edge 82 of the lock bar 66 is withdrawn from, or positioned out of, the locking groove 44. In the depicted lock 20, the lock bar biasing means 108 includes a compression spring 110 adapted to act between the cylinder body 48 and the lock bar 66 for urging the lower edge 84 of the lock bar 66 against the shoulder surfaces 104 of the tumblers 64. As best shown in FIG. 6, the compression spring 110 includes two opposite ends and is positioned within the notch 86 of the lock bar 66 so that one of its ends engages the bottom of the notch 86 and the other of its ends engages a small steel ball 112. The steel ball 112 is positioned within the lock bar-accepting slot 88 of the cylinder body 48 and secured therein by means of a protuberance 114 (FIGS. 5 and 5*a*) formed in the cylinder body 48 over the top of the slot 88 to prevent the ball 112 from exiting the top of the slot 88. It will be understood that the protuberance 114 is formed over the top of the slot 88 after the lock bar 66, spring 110 and ball 112 have been positioned within the slot 88 during assembly of the lock 20 and may be formed by forcibly indenting the surface of the cylinder body 48 adjacent the slot 88 and ball 112. Consequently, as the spring 110 urges the bottom of the lock bar notch 86 away from the ball 112, the spring 110 acts against the cylinder body 48 to urge the lock bar 66 toward its FIG. 9 retracted position.

With reference to FIGS. 7–10, the lock 20 also includes means, indicated 116, for biasing each tumbler 64 from its FIG. 10 extended position to its FIG. 8 retracted position. In the depicted lock 20, the tumbler biasing means 116 includes a plurality of compression springs 118 interposed between the tabs 100 of the tumblers 64 and a shoulder 120 (FIG. 8) provided in one side of the tumbler-receiving slots defined in the cylinder body 48. Each spring 118 has one end which is positioned in engagement with the shoulder 120 and another end which engages so as to act against the tab 100 of a corresponding tumbler 64. As the compression springs 118 urge the tumbler tabs 100 away from the shoulders 120, each tumbler 64 is urged from its FIG. 10 extended position to its FIG. 8 retracted position. It follows from the foregoing that the permitted movement of the lock bar 66 relative to the housing 22 is substantially parallel to the permitted movement of the tumblers 64 relative to the housing 22, and that the springs 110, 118 act in parallel directions and in opposition to one another through the tumblers 64 and lock bar 66.

Normally, the springs 110, 118 maintain the lower edge 84 of the lock bar 66 in abutting relationship with the shoulder surface 104 of the tumbler tab portion 102 as illustrated in FIGS. 8 and 9. The lock bar 66 and tumblers 64 are appropriately sized with respect to one another so that as the lock bar lower edge 84 engages the tab portion shoulder surface 104 and the tumblers 64 are in the fully retracted position as shown in FIG. 8, the lock bar upper edge 82 is positioned within the locking groove 44. When the lock bar 66 is moved to its FIG. 9 retracted position so that its upper edge 82 is withdrawn from the locking groove 44 and the lock bar lower edge 84 is maintained in engagement with the tab portion shoulder surface 104, the tab portions 102 of the tumblers 64 are positioned out of the locking groove 46. It follows that with the lock bar 66 and tumblers 64 positioned in the position of FIG. 9, the cylinder 24 is permitted to rotate within the housing 22 to, for example, the position illustrated in FIG. 11.

When the key 25 (FIG. 9) is removed from the key-receiving slot 28 of the cylinder 24 and the cylinder 24 is in its lock mode position, the upper edge 82 of the lock bar 66 is received by the locking groove 44. Accordingly, the tumbler compression springs 118 collectively possess a greater strength, e.g., about twice the strength, than that of the lock bar compression spring 110 so that when the cylinder 24 is in its lock mode, the lock bar 66 is maintained in its FIG. 8 extended position by the strength of the tumbler compression springs 118. Of course, as long as the upper edge 82 of the lock bar 66 is positioned within the locking groove 44, the cylinder 24 is prevented from rotating relative to the housing 22.

Figure 11:
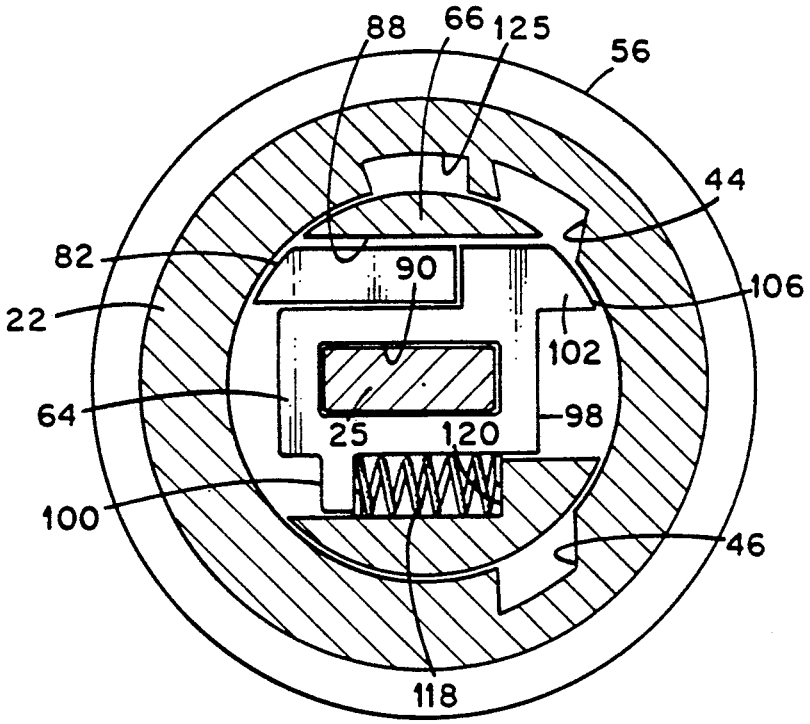
FIG. 11 is a view similar to that of FIG. 9 illustrating a position of the cylinder relative to the housing of the lock when the cylinder is rotated out of its lock mode position.

In order to rotate the cylinder 24 from its FIG. 8 lock mode position to the unlock mode position of FIG. 11, the key 25 is inserted within the cylinder 24 in order to force the tumblers 64 to move from the fully retracted position of FIG. 8 in opposition to the force of the tumbler springs 118 to the aforedescribed intermediate position of FIG. 9 at which the tumbler tab portions 102 remain withdrawn from the locking groove 46. Movement of the tumblers 64 to the FIG. 9 intermediate position permits the lock bar compression spring 110 to move the lock bar 66 from its extended position of FIG. 8 to its retracted position of FIG. 9. Accordingly, the key 25 is appropriately sized to effect the movement of the tumblers 64 to the intermediate position upon its full insertion into the cylinder slot 28. Once inserted, the key 25 may be rotated clockwise as viewed in FIG. 9 to rotate the cylinder 24 to the position illustrated in FIG. 11 so that the locking member 26 (FIG. 1) is moved to its unlocked, or horizontal position. To return the lock 20 to its locked position when the cylinder 24 is positioned in its unlock mode, the cylinder 24 is simply rotated in the appropriate direction with the key 25 to reposition the lock bar 66 in registry with the locking groove 44. Subsequent removal of the key 25 permits the lock bar 66 to be moved in locking engagement with the groove 44 as illustrated in FIG. 8.

The lock 20 is advantageous for its resistance to being picked by conventional techniques which involve the insertion of a picking instrument into the keyway slot of the cylinder to force the tumblers of the lock to an unlocked condition and simultaneously exerting a torsion force to the cylinder. In order to rotate the cylinder 24 of the depicted lock 20, and as mentioned above, both the lock bar 66 and tumblers 64 must be retracted from the locking grooves 44 and 46. If, on one hand, torsion forces are exerted upon the cylinder 24 when the lock bar 66 is positioned in its FIG. 8 extended position, the resulting contact between a side of the upper edge 82 of the lock bar 66 and a sidewall of the locking groove 44 binds the lock bar 66 in position and prevents the cylinder 24 from being rotated. If, on the other hand, any of the tumblers 64 are manipulated downwardly to the extended position of FIG. 10 by a picking instrument 122 (FIG. 10) so that the tab portion end 106 is accepted by the locking groove 46, the cylinder 24 is prevented from rotating in either rotational direction by the resulting contact between the tumbler tab portion 102 and a sidewall of the locking groove 46. If, of course, the tab portion 102 of a tumbler is positioned within the locking groove 46, the cylinder 24 is prevented from rotating whether the lock bar 66 is positioned within or out of the locking groove 44.

Another advantage provided by the lock 20 relates to the provision of the locking groove 125 adjacent the locking groove 44. With the locking groove 125 disposed to one side of the lock bar-receiving groove 44, or in a counter-clockwise direction from the groove 44 as illustrated in FIGS. 8–11, the lock bar 66 is required to be moved across the groove 125 when the cylinder body 48 is rotated between locked and unlocked positions. If, on one hand, the appropriate key 25 is positioned within the key-receiving slot 28, the lock bar 66 is maintained in its retracted FIG. 9 position so that the lock bar 66 does not enter the groove 125 as the lock bar 66 is moved thereacross. If, on the other hand, the lock bar 66 were somehow manipulated during a picking operation out of the locking groove 44 so that the cylinder body 48 could be rotated out of its locked position and the upper edge 82 of the lock bar 66 is forced to slide along the surface of the housing bore 38 as the cylinder body 48 is rotated, the compression spring 110 is likely to force the upper edge 82 of the lock bar 66 into the groove 125 when the lock bar 66 moves into registry with the groove 125. With the lock bar edge 82 received by the groove 125, further rotation of the cylinder body 48 toward its unlocked position is prevented. Thus, the provision of the groove 125 adjacent the groove 44 further enhances the pick-resistant qualities of the lock 20 and is advantageous in this respect.

A further advantage provided by the lock 20 relates to the action of the compression springs 110 and 118 in opposition to one another. Such opposing action of the springs 110 and 118 is preferred over action of springs whose directions of force are applied in a generally angular relationship to one another and is believed to enhance the smoothness of operation of the lock 20.

It will be understood that numerous modifications and substitutions may be had to the aforedescribed embodiment without departing from the spirit of the invention. Accordingly, the aforedescribed embodiment is intended for the purpose of illustration and not as limitation.

I claim:

1. A lock comprising:

a housing having a bore and a pair of locking grooves defined in and arranged along the surface of the bore so that the locking grooves generally open toward one another across the bore;

a key-accepting cylinder mounted within the bore of the housing for accepting a key inserted into the cylinder and for rotation relative to the housing about a rotational axis between one angular position and another angular position;

a plurality of tumblers mounted within the cylinder for movement relative thereto along linear parallel paths oriented substantially transverse to the rotational axis of the cylinder and between a first retracted position, a second retracted position and an extended position wherein the second retracted position is intermediate of the first retracted position and the extended position, each tumbler including a tab portion which is positioned within one locking groove of the housing to prevent the cylinder from rotating within the housing when the tumbler is positioned in its extended position and which is withdrawn from said one locking groove when the tumbler is positioned in either of its first and second retracted positions;

a lock bar mounted within the cylinder for movement relative thereto along a linear path which is oriented generally parallel to the paths along which the tumblers are permitted to move relative to the cylinder and between an extended position and a retracted position, the lock bar having a protruding portion which is positioned within the other locking groove of the housing to prevent the cylinder from rotating when the lock bar is positioned in its extended position and which is withdrawn from said other locking groove when the lock bar is positioned in its retracted position;

means associated with the tumblers for biasing each tumbler from its extended position toward its first retracted position; and means associated with the lock bar for biasing the lock bar from its extended position toward its retracted position so that the lock bar and tumblers are biased by the corresponding biasing means in opposite directions, the lock bar and tumblers being arranged in such a relationship that the tumblers and the lock bar are urged against one another by the aforesaid biasing means, the tumbler biasing means and the lock bar biasing means possessing predetermined strengths so that when the cylinder is positioned in said one angular position and no key is positioned within the cylinder, the lock bar is positioned in its extended position and each tumbler is positioned in its first retracted position;

the lock bar being cooperable with said other locking groove when the cylinder is in said one angular position so that when torsion is applied to the cylinder without the proper key inserted therein, the protruding portion of the lock bar binds within said other locking groove to prevent the cylinder from rotating relative to the housing, and the tumblers being cooperable with said one locking groove when the cylinder is in said one angular position so that when a tumbler is moved into its extended position, the tumbler tab portion is received by said one locking groove to prevent the cylinder from rotating.

2. The lock as defined in claim 1 wherein the lock bar is positioned generally alongside each tumbler for movement of the lock bar relative to the housing linearly along one side of each tumbler.

3. The lock as defined in claim 1 wherein the tab portion of each tumbler protrudes generally from one side thereof and the lock bar is biased by the lock bar biasing means into engagement with the tab portions of the tumblers.

4. The lock as defined in claim 1 wherein the lock bar biasing means is adapted to act between the cylinder and the lock bar as the lock bar is urged toward its retracted position.

5. The lock as defined in claim 1 wherein the tumbler biasing means is adapted to act between the cylinder and the tumblers as the tumblers are urged toward their first retracted position.

6. The lock as defined in claim 1 wherein the housing includes another locking groove defined in the surface of the bore and positioned adjacent said other locking groove for receiving the lock bar to prevent the cylinder from being rotated toward said another angular position when the lock bar is moved into alignment with said another locking groove as the cylinder is rotated out of the one angular position and the lock bar is not maintained in its retracted position so that if the lock bar was manipulated out of said other locking groove and the cylinder rotated out of the one angular position, said another locking groove is in position to accept the lock bar when the lock bar is moved into alignment with said another locking groove to prevent the cylinder from being rotated to said another angular position.

* * * * *